US006094141A

United States Patent [19]

Tsai

[11] Patent Number: 6,094,141

[45] Date of Patent: Jul. 25, 2000

[54] LOW POWER-CONSUMPTION LUMINOUS DECORATIVE/WARNING MEANS

[76] Inventor: Ching-Tien Tsai, No. 6, Kwang Fu Road, Erh-Lin City, Chang-Hua Hsien, Taiwan

[21] Appl. No.: 09/304,470

[22] Filed: May 3, 1999

[51] Int. Cl.[7] ..... G08B 23/00

[52] U.S. Cl. ..... 340/573.1; 340/669; 340/683; 340/573.1; 340/362; 340/691.1; 340/691.8; 36/137; 362/189; 362/84

[58] Field of Search ..... 340/669, 683, 340/573.1, 362, 691.1, 691.8; 36/137; 362/189, 84

[56] References Cited

U.S. PATENT DOCUMENTS

| | | | |
|---|---|---|---|
| 4,360,905 | 11/1982 | Hackett | 367/94 |
| 4,848,009 | 7/1989 | Rodgers | 36/137 |
| 5,303,485 | 4/1994 | Goldston et al. | 36/137 |
| 5,456,032 | 10/1995 | Matsumoto et al. | 40/636 |
| 5,477,435 | 12/1995 | Rapisarda et al. | 362/189 |
| 5,746,500 | 5/1998 | Chien | 362/103 |
| 5,758,946 | 6/1998 | Chen | 362/103 |

*Primary Examiner*—Daniel J. Wu
*Assistant Examiner*—Tai T. Nguyen
*Attorney, Agent, or Firm*—W. Wayne Liauh

[57] ABSTRACT

A decorative/warning luminous means emitting flashes only in a vibrating state and in the night and therefore consuming only very small amount of power. The decorative/warning luminous means includes an actuating unit consisting of serially connected photo-sensor circuit, resistor, and vibration switch and capable of detecting surrounding luminance and vibrating condition. The actuating unit has two ends connected to two electrodes of a DC power source and outputs a trigger signal that is a signal of voltage value detected at a position between the photo-sensor and the resistor for actuating the decorative/warning luminous means to produce flashes. The actuating unit is always in an open state and does not consume any power in the daytime, so long as the decorative/warning luminous means is not actuated.

8 Claims, 6 Drawing Sheets

LOW POWER-CONSUMPTION LUMINOUS DECORATIVE/WARNING MEANS

BACKGROUND OF THE INVENTION

The present invention relates to a luminous decorative/warning means, and more particularly to a decorative/warning means that is attached to hats, shoes, knapsacks, etc. and emits light only when it is vibrated in the night, and therefore consumes very small amount of power.

There are light emitting means developed for mounting on shoes, knapsacks, hats, etc. in anticipation of securing safety of children and adults walking in the night. U.S. Pat. Nos. 4,848,009 and 5,406,724 all disclose such light emitting means.

U.S. Pat. No. 4,848,009 discloses a light emitting means for mounting on shoes, a circuit diagram of which is shown in FIG. 1. The light emitting means includes a vibration-type starting switch 10, such as a mercury switch. When a user wears shoes provided with such light emitting means and walks, the starting switch 10 is actuated to make a circuit provided in the light emitting means, so that a light source 11 gives out light. The circuit provided in the light emitting means disclosed in U.S. Pat. No. 4,848,009 could not judge the luminance of surrounding environment. An integrated circuit 12 in the circuit of the light emitting means is always actuated when the starting switch 10 is actuated and thereby causes the light source 11 to give out light. That is, the light emitting means disclosed in U.S. Pat. No. 4,848,009 emits light even in the daytime so long as the means is under a vibrating condition. The means therefore consumes a lot of power.

U.S. Pat. No. 5,406,724 also discloses a light emitting means for mounting on shoes, a circuit diagram of which is shown in FIG. 2 As shown, there is a photo sensor 13 included in the circuit to detect a luminance of the surrounding environment at the time the light emitting means is actuated, and a detected result is used as a basis as to whether an integrated circuit 14 in the light emitting means is to be actuated or not. With these arrangements, a small lamp 15 of the light emitting means would not lighten in the daytime. However, the photo sensor 13 needs continuous power supply to function normally. That is, the light emitting means disclosed in U.S. Pat. No. 5,406,724 is always in a state of consuming power, too.

Since the above-mentioned light emitting means are fixedly mounted on shoes and usually sealed in soles or heels of the shoes in a watertight manner to ensure normal function thereof, they would soon become useless when a power supply inside the means is quickly exhausted due to continuous consumption of power by the means.

It is therefore desirable to develop a low power-consumption luminous means to eliminate drawbacks existing in the conventional light emitting means mounted on shoes for warning purpose.

SUMMARY OF THE INVENTION

A primary object of the present invention is to provide a low power-consumption luminous decorative/warning means, in a circuit of which a unique actuating unit is included to detect both surrounding luminance and vibrating state, so that the luminous decorative/warning means is controlled to emit flashes only when the actuating unit is actuated due to vibration in the night. So long as the actuating unit is not actuated, it is always in an open state in the daytime and does not consume any power. Therefore, the luminous decorative/warning means of the present invention consumes much lower power than the conventional light emitting means.

To achieve the above and other objects, the present invention according to a preferred embodiment thereof mainly includes a DC power supply unit, a light-emitting unit, a control unit, and an actuating unit. The light-emitting unit includes at least one light emitting element. The control unit is connected to the DC power supply unit and the light-emitting unit for controlling the light emitting element of light-emitting unit to accept power supplied by the DC power supply unit and to produce predetermined times of flashes of predetermined frequency. The control unit includes at least a signal input circuit that may be induced by an input trigger signal (i.e. a signal of voltage value) to cause the control unit to control the light-emitting unit to produce flashes. The actuating unit is connected to the DC power supply unit and the signal input circuit of the control unit for sending a trigger signal to the signal input circuit for producing flashes. The actuating unit includes at least a photo-sensor, a resistor, and a vibration switch connected in series. Two ends of the actuating unit are connected to two electrodes of the DC power supply unit and the signal input circuit is coupled with the actuating unit at a position between the photo-sensor and the resistor for detecting the voltage value thereof, so that the detected voltage value is used as the trigger signal.

With the above arrangements, when the vibration switch is not actuated or in an open state, the whole serially connected actuating unit is also in an open state without consuming any power, and there is not distinct change in voltage values detected by the signal input circuit in the daytime and in the night (that is, the actuating unit will not send out a trigger signal). Only when the vibration switch is actuated, will the actuating unit be a close state and will the photo-sensor have different resistance in the daytime and in the night (because the surrounding luminance is higher than a predetermined value in the daytime and lower in the night) to result in different voltage values detected between the photo-sensor and the resistor of the actuating unit. In brief, the signal input circuit will receive a trigger signal to drive the control unit to cause the light-emitting unit to produce predetermined times of flashes of predetermined frequency only when the vibration switch is actuated in the night.

DETAILED DESCRIPTION OF THE PREFERRED EMBODIMENTS

Figure 1:
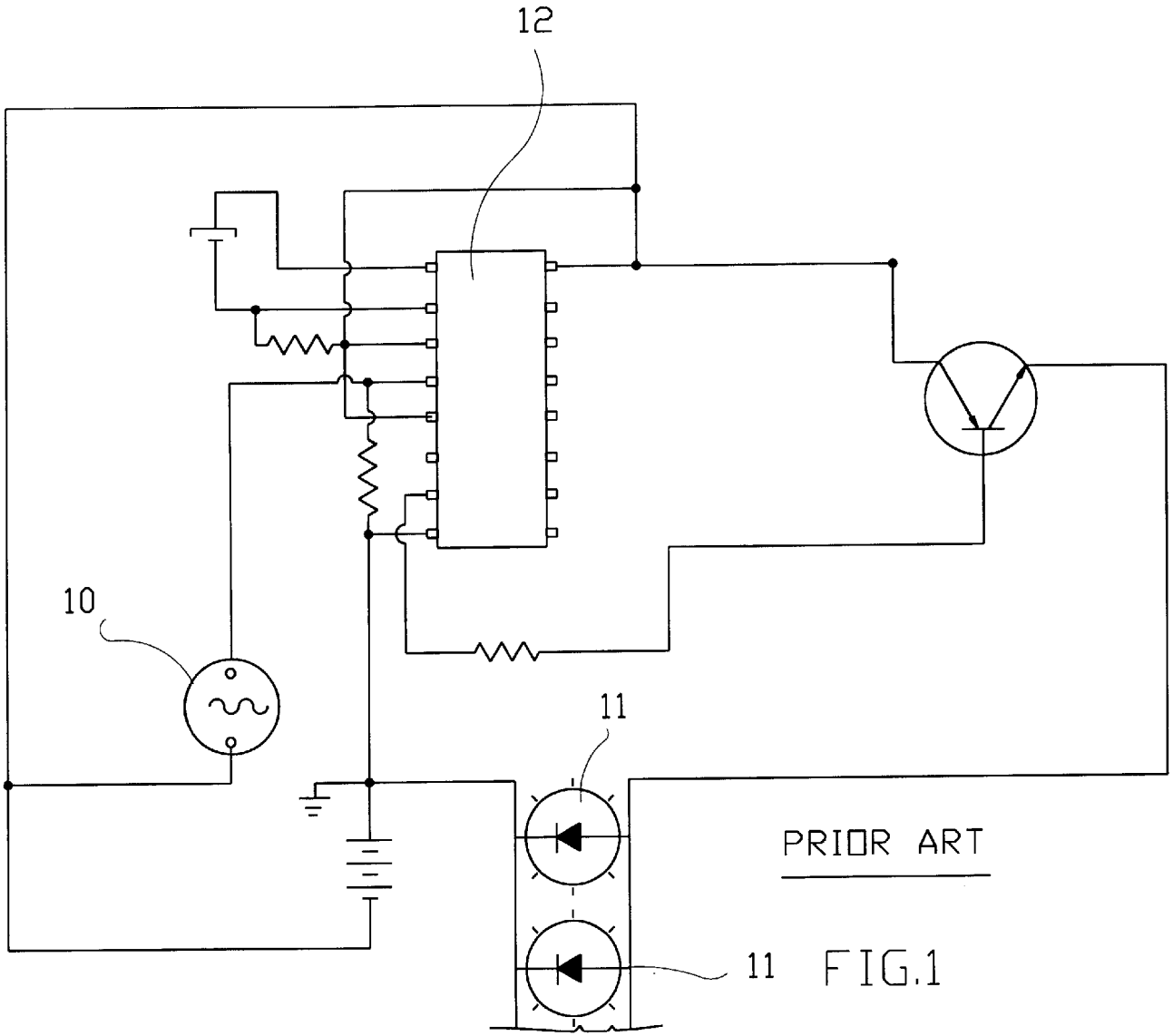
PRIOR ART FIG.1
FIG. 1 is a circuit diagram of the disclosure of U.S. Pat. No. 4,848,009.
Figure 2:
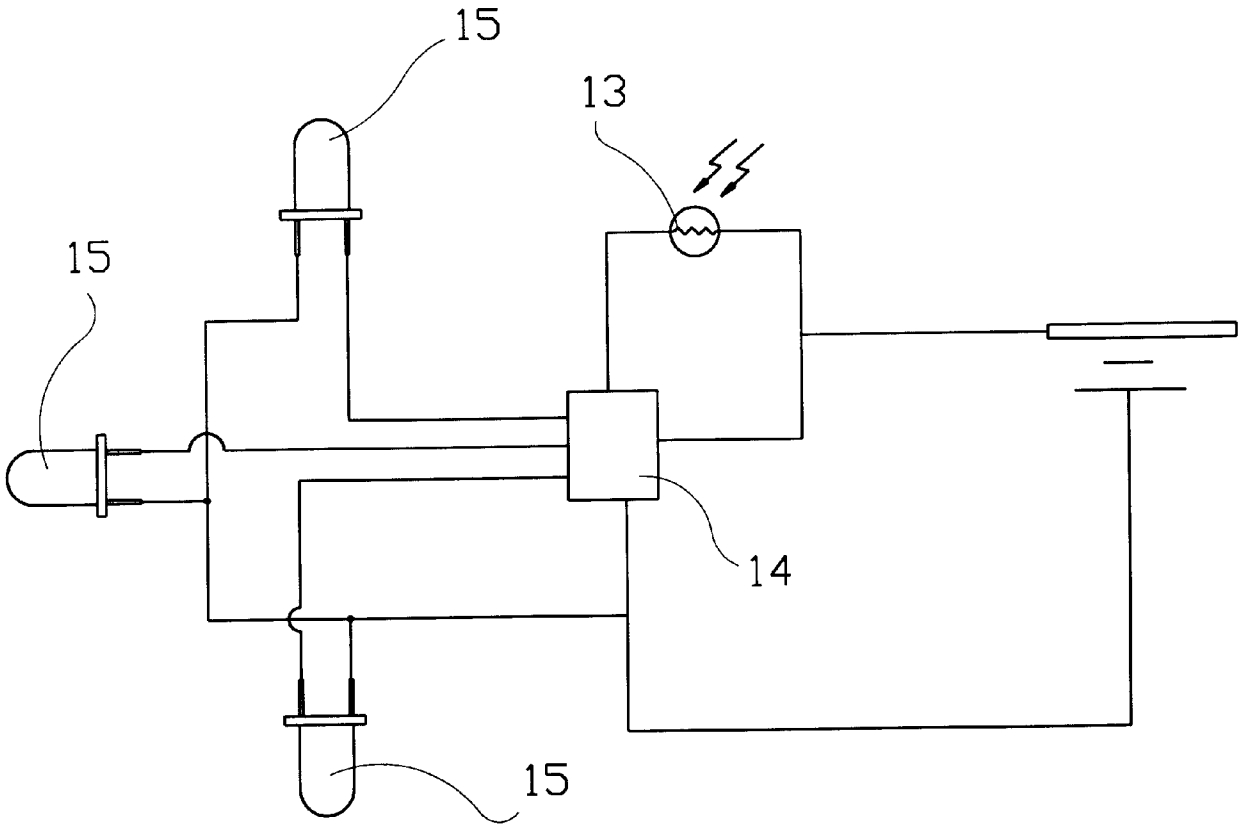
PRIOR ART FIG.2
FIG. 2 is a circuit diagram of the disclosure of U.S. Pat. No. 5,406,724.
Figure 3:
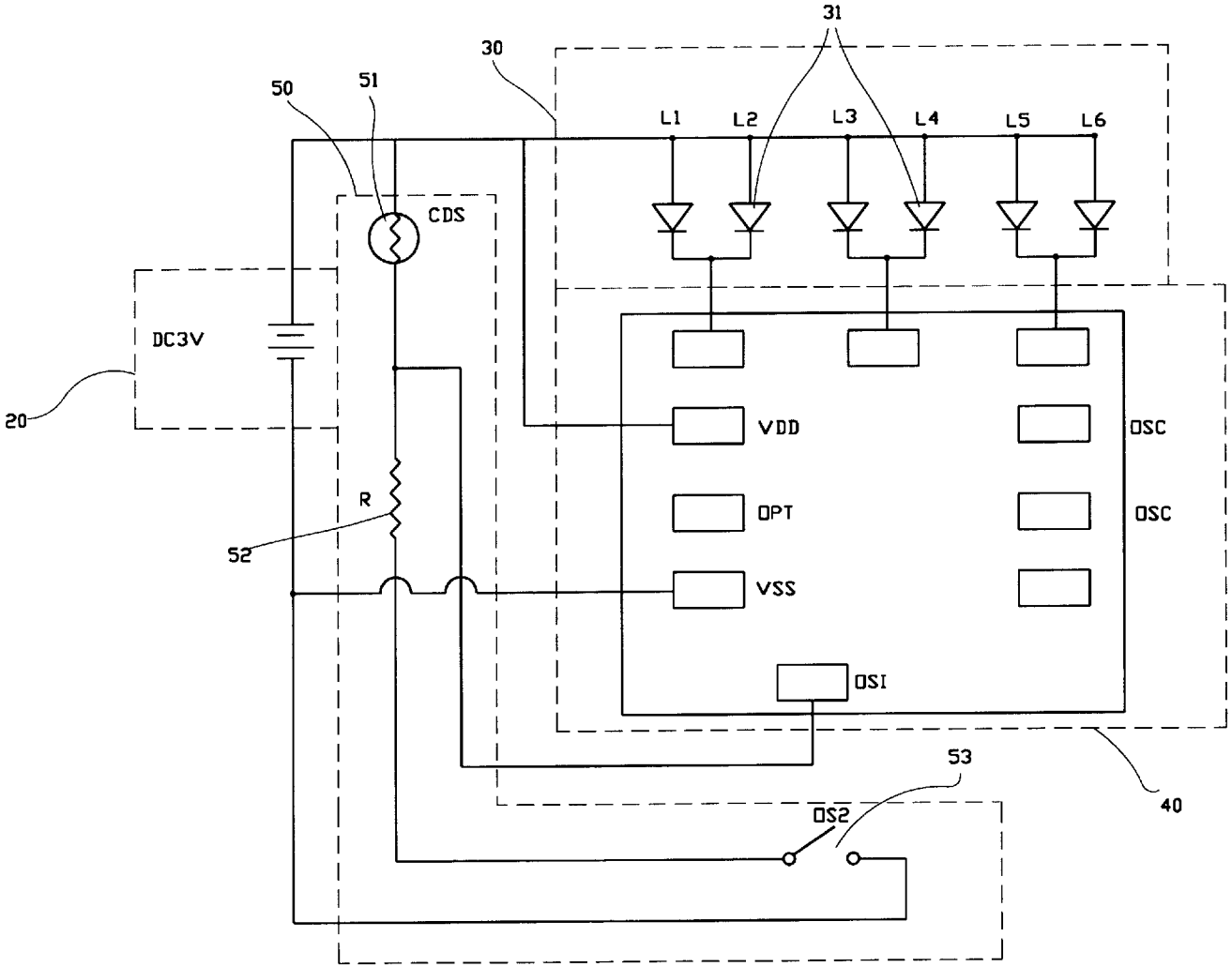
FIG. 3 is a circuit diagram of the low power-consumption luminous decorative/warning means of the present invention.

Please refer to FIG. 3 that is a circuit diagram of a low power-consumption luminous decorative/warning means according to a preferred embodiment of the present invention. As shown, the circuit designed for the present invention mainly includes a DC power supply unit 20, a light-emitting unit 30, a control unit 40, and an actuating unit 50.

In the preferred embodiment of the present invention, the DC power supply unit 20 includes preferably two mercury batteries connected in series. Two ends of the serially connected mercury batteries have extended positive and negative electrodes for power output. The light-emitting unit 30 includes at least six light emitting elements 31, namely, L1, L2, L3, L4, L5, and L6. It is preferable the light emitting elements 31 are light-emitting diodes (LED's). However, it is understood other different types and/or numbers of light emitting elements 31 may also be selected for the present invention. The control unit 40 is electrically connected to the DC power supply unit 20 and the light-emitting unit 30 for controlling the light emitting elements 31 of the light-emitting unit 30 to accept power supplied by the DC power supply unit 20 and thereby emits flashes. The actuating unit 50. is electrically connected to the DC power supply unit 20 and the control unit 40 mainly for sending a trigger signal to the control unit 40, so that the control unit 40 is actuated to start controlling the light emitting elements 31 to emit flashes.

Figure 4:
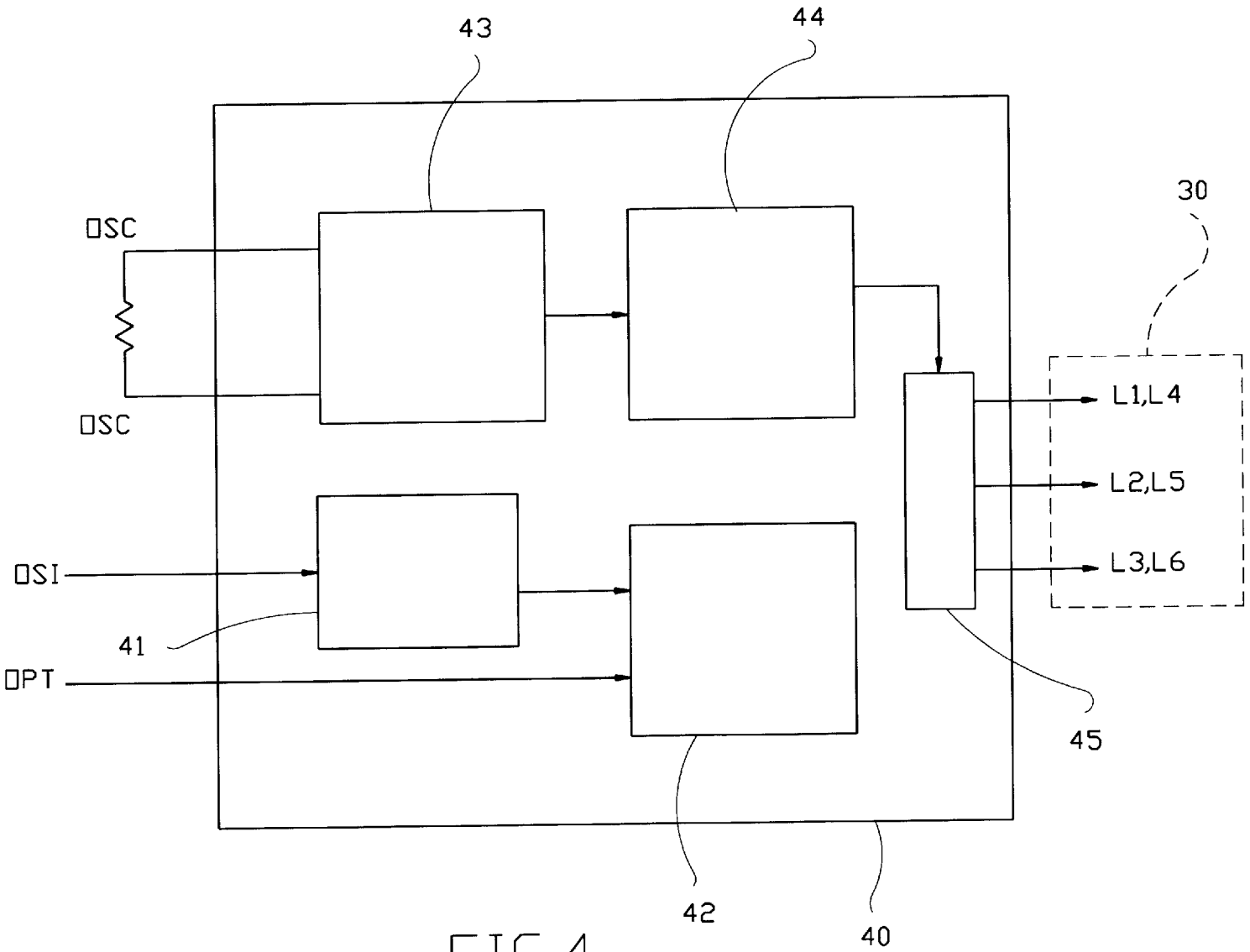
FIG. 4 is a block diagram of a control unit included in the circuit of the present invention of FIG. 3.

FIG. 4 is a block diagram of the control unit 40 according to the preferred embodiment of the present invention. In the preferred embodiment, the control unit 40 is a programmable integrated circuit having a working voltage ranging from 1.5V to 5.0V DC, a minimum output current of 30mA at a voltage of 3V DC, and a static current below 1mA. The control unit 40 has contacts $V_{DD}$ and $V_{ss}$ coupled with the positive and negative electrodes, respectively, of the DC power supply unit 20, and includes a signal input circuit 41, a flash counting circuit 42, a frequency modulation circuit 43, a flash pattern generation circuit 44, and an amplifying circuit 45.

The signal input circuit 41 has a signal input contact OS1 and can be induced by an input trigger signal to cause the control unit 40 to start controlling the light-emitting unit 30 for the latter to emit flashes. The flash counting circuit 42 is electrically connected to the signal input circuit 41. When the signal input circuit 41 is induced by the trigger signal and actuated, the flash counting circuit 42 is also actuated to control and count times of flash of each light emitting element 31 in the light-emitting unit 30. The frequency modulation circuit 43 controls frequency and time delay of flashes produced by the light emitting elements 31. A frequency modulation switch is connected to the frequency modulation circuit 43 for modulating time delay and frequency of flashes produced by the light emitting elements 31 through selection of different OSC contacts. The flash pattern generation circuit 44 is electrically connected to the flash counting circuit 42 and the frequency modulation circuit 43 to accept and convert control signals from the two circuits into signals for controlling each light emitting elements 31 to produce predetermined times of flashes of predetermined frequency. A flashing times adjusting switch is connected to the flash counting circuit 42 for adjusting times of flashing of the light emitting elements 31 through selection of different OPT contacts. The amplifying circuit 45 is located between and electrically connected to the flash pattern generation circuit 44 and the light-emitting unit 30 to amplify signals from the flash pattern generation circuit 44 and then send the amplified signals to the light emitting elements 31 of the light-emitting unit 30.

In the preferred embodiment of the present invention, the flash pattern generation circuit 44 can send signals to first cause the light emitting elements L1 and L4 to flash at the same time, and then light emitting elements L2 and L5, and finally light emitting elements L3 and L6, completing one cycle of flashing. Total eight cycles of flashing are performed, making the luminous decorative and warning means of the present invention look like a revolving lantern. It is also possible to adjust the number of OPT and OSC contacts in order to change the times of flashing (i.e., number of cycles of flashing) as well as the frequency of flashes produced by the light emitting elements 31. Moreover, by changing designs for the flash pattern generation circuit 44 in the control unit 40 that is a programmable integrated circuit, one can easily cause the light-emitting unit 30 to flash in different manners and patterns.

Please refer back to FIG. 3. The actuating unit 50 is electrically connected to the DC power supply unit 20 and the signal input circuit 41 (contact OS1) of the control unit 40, and can send trigger signals to the signal input circuit 41. The actuating unit 50 includes at least a photo-sensor 51 (CDS), a resistor 52 (R), and a vibration switch 53 (OS2) connected to one another in series. The photo-sensor 51 and the vibration switch 53 at two ends of the actuating unit 50 are coupled with positive and negative electrodes of the DC power supply unit 20, respectively, and the contact OS1 of the signal input circuit 41 is coupled with the actuating unit 50 to locate between the photo-sensor 51 and the resistor 52. In the preferred embodiment of the present invention, the signal input circuit 41 is a bias circuit for detecting a signal of voltage value at a position between the photo-sensor 51 and the resistor 52. The detected signal of voltage value is also the above-mentioned trigger signal. Therefore, when the signal input circuit 41 detects a voltage value at the contact OS1 that is lower than (or higher than) a predetermined voltage value, the control unit 40 would be triggered to control the light-emitting unit 30 for the same to emit flashes.

Figure 5:
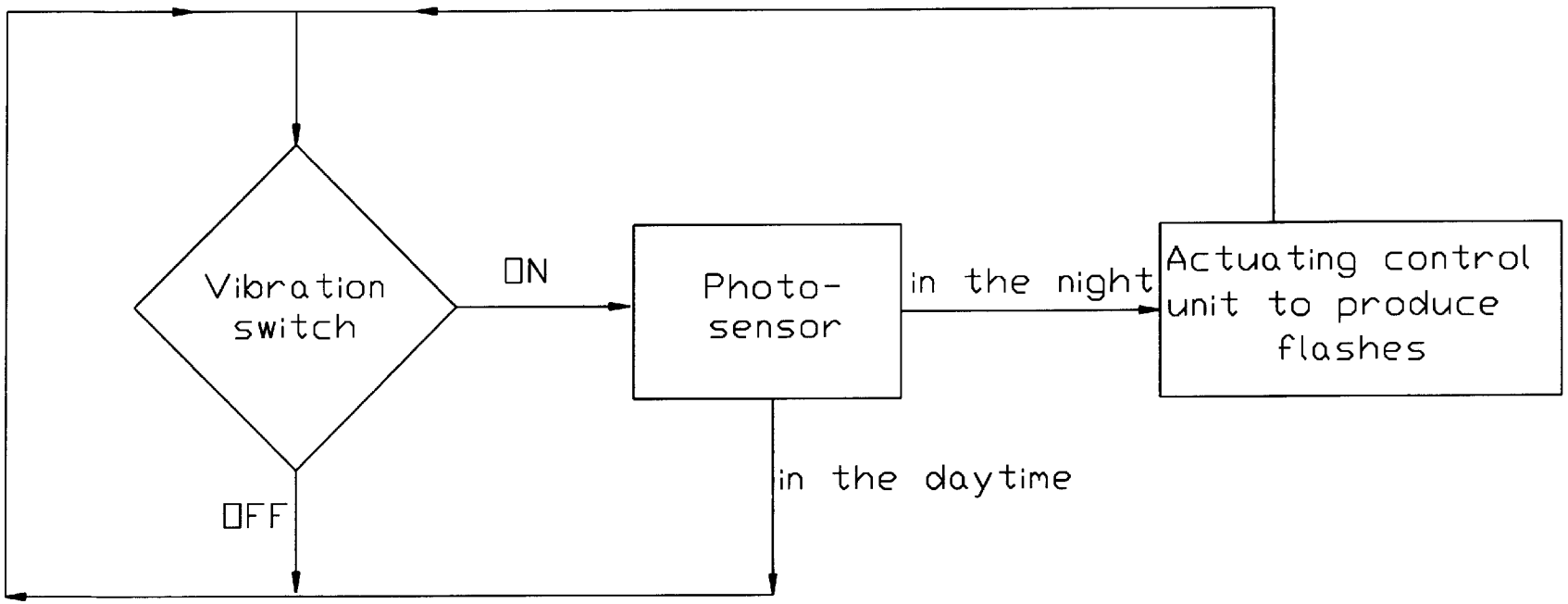
FIG. 5 is a flowchart of functioning procedures included in the present invention.

Please now refer to FIG. 5 that is a flowchart of functioning procedures of the present invention in a working state. When the vibration switch 53 in the above-described circuit for the present invention is not actuated (that is, the vibration switch 53 is in an open or OFF state), the whole serially connected actuating unit 50 is in an open state and there is not any current passing through the photo-sensor 51. In other words, the photo-sensor 51 does not consume any power at this point. Therefore, no matter it is in the daytime or in the night, the signal of voltage value detected at the contact OS1 of the signal input circuit 51 is always high and has not obvious change. That is, the actuating unit 50 would not send any trigger signal. Only when the vibration switch 53 is actuated, will the actuating unit 50 be close or ON with current flowing through the photo-sensor 51. At this point, the photo-sensor 51 will have a lower effective resistance in the daytime (the surrounding environment has a luminance higher than a predetermined value) and a higher effective resistance in the night (the surrounding environment has a luminance lower than a predetermined value). As a result, there will be different signals of voltage value at the same position between the photo-sensor 51 and the resistor 52. That is, in the preferred embodiment of the present invention, the signal of voltage value detected at the contact OS1 is high in the daytime, but is low in the evening or night because the effective voltage of the photo-sensor 51 rises. This makes the signal input circuit 41 of the present invention to detect any trigger signal (i.e. a signal of low voltage value) only in the night and only when the vibration switch 53 has been actuated. It is only in this condition will the control unit 40 be actuated to control the light-emitting unit 30 to produce flashes.

Figure 6:
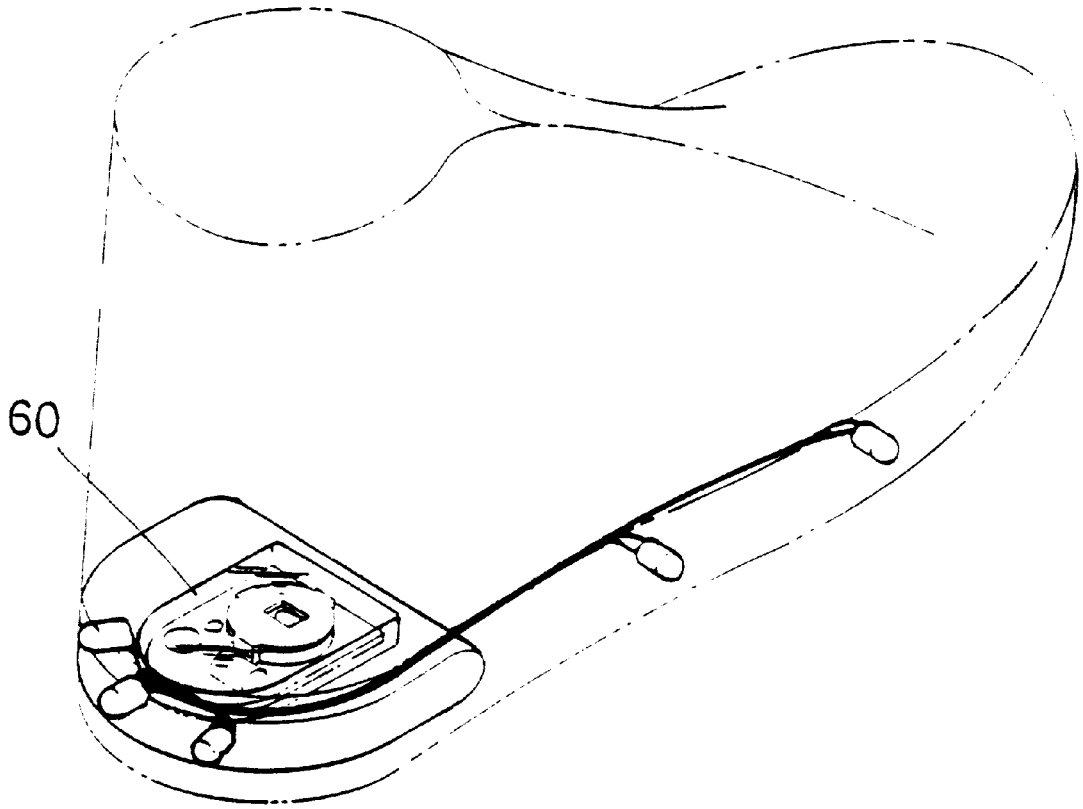
FIG. 6 schematically illustrates the use of the present invention on a shoe.

FIG. 6 illustrates a low power-consumption luminous decorative/warning means of the present invention being used on a shoe. For the circuit in the present invention to be waterproof and pressure-tight, a circuit board thereof is sealed with rigid and clear resin 60.

In brief, low power consumption is taken into consideration in designing the ability of the present invention of detecting working environment, enabling the present invention to function only in the night having a low luminance and in a vibrating state. The luminous decorative/warning means of the present invention can therefore have prolonged usable life.

What is claimed is:

1. A low power-consumption luminous decorative/warning means, comprising:

a DC power supply unit having positive and negative electrodes for power output;

a light-emitting unit including at least one light emitting element;

a control unit electrically connected to said DC power supply unit and said light-emitting unit for controlling said light emitting element of said light-emitting unit to accept power supplied by said DC power supply unit and produce flashes, said control unit including at least one signal input circuit that is induced by an input trigger signal to cause said control unit to control said light-emitting unit to start producing said flashes; and an actuating unit electrically connected to said DC power supply unit and said signal input circuit of said control unit for sending a trigger signal to said signal input circuit to cause said control unit to control said light-emitting unit to start producing said flashes, said actuating unit including at least a photo-sensitive resistor, a non-photo-sensitive resistor, and a vibration switch connected in series and in such order, two ends of said actuating unit being separately coupled with said positive and said negative electrodes of said DC power supply unit, and said signal input circuit is connected to said actuating unit at a point between said photo-sensitive resistor and said non-photo-sensitive resistor, so that said signal input circuit will receive a high or low voltage when said photo-sensitive resistor is exposed to light, and a reversed voltage in the absence of light exposure.

2. A low power-consumption luminous decorative/warning means as claimed in claim 1, wherein said trigger signal sent by said actuating unit is a signal of voltage value at a position between said photo-sensor and said resistor, and when said signal of voltage value between said photo-sensor and said resistor detected by said signal input circuit being lower than a predetermined voltage value, said control unit is triggered to control said light-emitting unit to start producing said flashes.

3. A low power-consumption luminous decorative/warning means as claimed in claim 1, wherein said control unit is a programmable integrated circuit.

4. A low power-consumption luminous decorative/warning means as claimed in claim 1, wherein said control unit further comprising:

a flash counting circuit electrically connected to said signal input circuit for controlling and counting times of flashing by each said at least one light emitting element of said light-emitting unit when said signal input circuit is induced by said trigger signal and actuated;

a frequency modulation circuit for controlling frequency and time delay of flashes produced by said light-emitting unit;

a flash pattern generation circuit electrically connected to said flash counting circuit and said frequency modulation circuit for receiving control signals from said flash counting circuit and said frequency modulation circuit and converting said received control signals into signals for controlling each said at least one light emitting element to produce predetermined times of flashes of predetermined frequency; and an amplifying circuit located between said flash pattern generation circuit and said at least one light emitting element of said light-emitting unit for amplifying signals sent from said flash pattern generation circuit and sending said amplified signals to said at least one light emitting element.

5. A low power-consumption luminous decorative/warning means as claimed in claim 4, wherein said flash counting circuit has a flashing times adjusting switch connected thereto for adjusting times of flashing of each said at least one light emitting element, and wherein said frequency modulation circuit has a frequency modulation switch connected thereto for adjusting time delay and frequency of flashes produced by said at least one light emitting element.

6. A low power-consumption luminous decorative/warning means as claimed in claim 1, wherein said signal input circuit is a bias circuit.

7. A low power-consumption luminous decorative/warning means as claimed in claim 1, wherein said at least one light emitting element is a light emitting diode.

8. A low power-consumption luminous decorative/warning means, comprising:

a DC power supply unit having positive and negative electrodes for power output;

a light-emitting unit including at least one light emitting element;

a control unit electrically connected to said DC power supply unit and said light-emitting unit for controlling said light emitting element of said light-emitting unit to accept power supplied by said DC power supply unit and produce flashes, said control unit including at least one signal input circuit that is induced by an input trigger signal to cause said control unit to control said light-emitting unit to start producing said flashes; and an actuating unit electrically connected to said DC power supply unit and said signal input circuit of said control unit for sending a trigger signal to said signal input circuit to cause said control unit to control said light-emitting unit to start producing said flashes, said actuating unit including at least a photo-sensitive resistor, a non-photo-sensitive resistor, and a vibration switch that are connected in series and in such order, two ends of said actuating unit being separately connected to said positive and said negative electrodes of said DC power supply unit, and signal input circuit is connected to said actuating unit at a point between said photo-sensitive resistor and said non-photo-sensitive resistor;

wherein said signal input circuit is a biased circuit that will cause said light-emitting unit to start producing said flashes only when receiving a low voltage signal, and said photo-sensitive resistor exhibits a low voltage upon light exposure and a high voltage in the absence of light exposure.

* * * * *